US008308929B2

(12) United States Patent
West

(10) Patent No.: US 8,308,929 B2
(45) Date of Patent: Nov. 13, 2012

(54) MICROFLUIDIC SYSTEMS AND METHODS FOR SCREENING PLATING AND ETCHING BATH COMPOSITIONS

(75) Inventor: Alan C. West, Tenafly, NJ (US)

(73) Assignee: The Trustees of Columbia University in the City of New York, New York, NY (US)

( * ) Notice: Subject to any disclaimer, the term of this patent is extended or adjusted under 35 U.S.C. 154(b) by 285 days.

(21) Appl. No.: 12/478,591

(22) Filed: Jun. 4, 2009

(65) Prior Publication Data

US 2010/0084286 A1 Apr. 8, 2010

Related U.S. Application Data

(63) Continuation of application No. PCT/US2007/086660, filed on Dec. 6, 2007.

(60) Provisional application No. 60/868,869, filed on Dec. 6, 2006.

(51) Int. Cl.
*G01N 27/403* (2006.01)

(52) U.S. Cl. ..... 205/81; 205/775; 204/400

(58) Field of Classification Search ..... 204/601–605, 204/451–455, 400; 422/502–507, 70; 324/425, 324/437, 450; 205/81–84, 775
See application file for complete search history.

(56) References Cited

U.S. PATENT DOCUMENTS 2,964,453 A 12/1960 Garn et al.
3,582,478 A 6/1971 Kelly et al.
3,790,738 A 2/1974 Laub et al.
4,169,770 A 10/1979 Cooke et al.
4,217,183 A 8/1980 Melcher et al.
4,229,264 A 10/1980 Graunke
4,283,259 A 8/1981 Melcher et al.
4,348,263 A 9/1982 Draper et al.
4,395,320 A 7/1983 Kasashima et al.
4,432,855 A 2/1984 Romankiw et al.
4,497,692 A 2/1985 Gelchinski et al.
4,629,539 A 12/1986 Imai
4,895,633 A 1/1990 Seto et al.
4,917,774 A 4/1990 Fisher
4,919,769 A 4/1990 Lin
5,202,291 A 4/1993 Charvat et al.
5,245,847 A 9/1993 Bando et al.
5,279,702 A 1/1994 Douglas
(Continued)

FOREIGN PATENT DOCUMENTS

CN 1793434 6/2006
(Continued)

OTHER PUBLICATIONS

U.S. Appl. No. 11/867,399, Oct. 19, 2011 Final Office Action.
(Continued)

*Primary Examiner* — Alex Noguerola
(74) *Attorney, Agent, or Firm* — Baker Botts, L.L.P.

(57) ABSTRACT

Methods and systems for screening for the effect of bath composition on the performance of electroplating, electroless-plating, electrochemical-etching, electropolishing, and chemical-etching processes are provided. The methods and systems use microfluidic channels that allow for etching or plating studies on an electrode exposed to a multitude of bath compositions at different positions on its surface. After deposition or etching, the electrode surface can be quickly and easily detached from the device for analysis of deposited or etched film properties.

17 Claims, 9 Drawing Sheets

U.S. PATENT DOCUMENTS

| | | | | |
|---|---|---|---|---|
| 5,292,418 | A | 3/1994 | Morita et al. | |
| 5,296,375 | A | 3/1994 | Kricka et al. | |
| 5,338,416 | A | 8/1994 | Mlcak et al. | |
| 5,364,510 | A | 11/1994 | Carpio | |
| 5,378,343 | A | 1/1995 | Kounaves et al. | |
| 5,704,493 | A | 1/1998 | Fujikawa et al. | |
| 5,906,723 | A * | 5/1999 | Mathies et al. | 204/603 |
| 5,928,880 | A | 7/1999 | Wilding et al. | |
| 5,932,799 | A | 8/1999 | Moles | |
| 6,042,712 | A | 3/2000 | Mathieu | |
| 6,110,354 | A | 8/2000 | Saban et al. | |
| 6,159,353 | A * | 12/2000 | West et al. | 204/601 |
| 6,165,630 | A | 12/2000 | Gehlhaar et al. | |
| 6,280,602 | B1 | 8/2001 | Robertson | |
| 6,334,980 | B1 | 1/2002 | Hayes et al. | |
| 6,391,559 | B1 * | 5/2002 | Brown et al. | 435/6.11 |
| 6,423,207 | B1 | 7/2002 | Heidari et al. | |
| 6,509,085 | B1 * | 1/2003 | Kennedy | 428/188 |
| 6,521,118 | B1 | 2/2003 | Starvetsky et al. | |
| 6,532,642 | B1 | 3/2003 | Wingo | |
| 6,787,012 | B2 | 9/2004 | Stanbery | |
| 6,936,167 | B2 * | 8/2005 | Hobbs et al. | 210/198.2 |
| 7,079,760 | B2 | 7/2006 | Hamelin et al. | |
| 7,192,559 | B2 * | 3/2007 | Chow et al. | 422/504 |
| 2002/0046949 | A1 * | 4/2002 | Nakamura et al. | 204/453 |
| 2002/0125142 | A1 * | 9/2002 | Sun et al. | 205/101 |
| 2002/0195345 | A1 | 12/2002 | Bensten et al. | |
| 2003/0008473 | A1 | 1/2003 | Sakaguchi et al. | |
| 2003/0029722 | A1 | 2/2003 | Erdosy et al. | |
| 2004/0166504 | A1 | 8/2004 | Rossier et al. | |
| 2005/0224359 | A1 | 10/2005 | Su et al. | |
| 2005/0241948 | A1 | 11/2005 | Han et al. | |
| 2006/0003579 | A1 | 1/2006 | Sir | |
| 2008/0142367 | A1 | 6/2008 | Von Gutfeld et al. | |
| 2008/0245674 | A1 | 10/2008 | von Gutfeld et al. | |
| 2008/0264801 | A1 * | 10/2008 | West et al. | 205/775 |
| 2008/0299780 | A1 | 12/2008 | Elliot et al. | |
| 2009/0081386 | A1 | 3/2009 | Von Gutfeld et al. | |
| 2011/0104396 | A1 | 5/2011 | Von Gutfeld et al. | |

FOREIGN PATENT DOCUMENTS

| | | | |
|---|---|---|---|
| JP | 60-204899 | A | 10/1985 |
| JP | 04-066679 | A | 3/1992 |
| JP | 2011071700 | | 4/2011 |
| WO | WO 95/10040 | A1 * | 4/1995 |
| WO | WO2006086407 | | 8/2006 |
| WO | WO 2006/110437 | | 10/2006 |

OTHER PUBLICATIONS

U.S. Appl. No. 11/867,399, Aug. 24, 2011 Response to Non-Final Office Action.

U.S. Appl. No. 11/867,399, Mar. 24, 2011 Non-Final Office Action.

U.S. Appl. No. 12/040,378, Oct. 10, 2011 Amendment and Request for Continued Examination (RCE).

U.S. Appl. No. 12/040,378, Oct. 4, 2011 Advisory Action.

U.S. Appl. No. 12/040,378, Sep. 20, 2011 Response to Final Office Action.

U.S. Appl. No. 12/040,378, Jun. 9, 2011 Final Office Action.

U.S. Appl. No. 12/040,378, Mar. 28, 2011 Response to Non-Final Office Action.

T. Kikuchi et al., "Local surface modification of aluminum by laser irradation", *Electrochimica Acta*, 2001: 225-234.

Lowenheim, F., Ed. John Wiley & Sons Inc.; Modern Electroplating; (3rd Edition); 194: 591-625.

O. Mallory, Glenn; Hajdu, Juan B.; Fundamentals and Applications; American Electroplaters and Surface Finishers Society; 1990: 193-204.

Ogden et al., "Cylic Voltaammetric Stripping Analysis of Copper Plating Baths", *Applications of Polarization Measurements in the Control of Metal Deposition*, 1984: 229-240.

Wills et al., "Laser micromachining of indium tin oxide films on polymer substrates by laser-induced delamination", *J. Phys. D: Appl. Phys.*, 42 (2009) 045306 (8pp).

U.S. Appl. No. 12/040,378, Oct. 28, 2010 Non-Final Office Action.

U.S. Appl. No. 11/767,461, Aug. 9, 2011 Non-Final Office Action.

U.S. Appl. No. 11/767,461, Jan. 26, 2012 Final Office Action.

U.S. Appl. No. 11/867,399, Feb. 21, 2012 Amendment and Request for Continued Examination (RCE).

U.S. Appl. No. 12/040,378, Apr. 27, 2012 Response to Non-Compliant.

U.S. Appl. No. 12/040,378, Apr. 10, 2012 Notice of Non-Compliant.

U.S. Appl. No. 12/040,378, Dec. 22, 2011 Non-Final Office Action.

U.S. Appl. No. 12/208,287, dated Jun. 29, 2012 Non-Final Office Action.

U.S. Appl. No. 12/040,378, dated Jun. 28, 2012 Final Office Action.

U.S. Appl. No. 11/767,461, dated Jul. 20, 2012 Amendment and Request for Continued Examination (RCE).

U.S. Appl. No. 11/767,461, dated Jul. 6, 2012 Advisory Action.

U.S. Appl. No. 11/767,461, dated Jun. 26, 2012 Response to Final Office Action.

U.S. Appl. No. 11/867,399, dated Aug. 21, 2012 Non-Final Office Action.

U.S. Appl. No. 11/767,461, dated Oct. 3, 2012 Final Office Action

Other Documents (Non-patent literature).

Darling, et al., "Integration of microelectrodes with etched microchannles for in-stream electrochemical analysis", *Micro Total Analysis Systems*, pp. 105-108 (1998).

* cited by examiner

MICROFLUIDIC SYSTEMS AND METHODS FOR SCREENING PLATING AND ETCHING BATH COMPOSITIONS

CROSS REFERENCE TO RELATED APPLICATIONS

This application is a continuation of International Application PCT/U.S.07/086,660, filed Dec. 6, 2007, which claims the benefit of U.S. Provisional Patent Application No. 60/868,869, filed Dec. 6, 2006, the contents of each of which are incorporated herein.

BACKGROUND OF THE INVENTION

Electrolyte baths, which are used for electroplating, electroless plating, chemical etching, electrochemical etching, and electropolishing of metals and alloys, typically contain a large number of chemical components. The type and amount of each chemical component of a bath may have an impact on the plating or etching rate and the properties of the resulting surface or deposit. Despite many scientific studies, optimal compositions of electrolyte baths for etching and deposition are often chosen empirically. Often, the type and amount of additives to include in an electrolyte bath are a key consideration in determining bath compositions to perform the desired plating or etching. In other cases, such as alloy deposition, the ratio of salts that yields the desired composition of the deposited film are a key consideration in determining bath composition.

When screening (i.e., comparing) electrolyte bath compositions for their effect on plating or etching performance, the quality (for example, microstructure, composition, surface roughness, surface contamination) of the resulting film is a key consideration. The effect of bath composition on deposition or etch rate may also be a key metric. Screening one electrolyte component or constituent at a time may be costly and time-consuming.

Consideration is now being given to improving systems and methods for screening plating and etching bath compositions. The desirable bath composition screening systems and methods will be able to quickly and accurately determine the effect of a multitude of a multitude of bath compositions on desired plating and etching process characteristics.

SUMMARY OF THE INVENTION

Systems and methods for screening electrolyte bath compositions for their effect (e.g., electroplating, electroless plating, electrochemical etching, and chemical etching) on substrates are provided. The systems and methods are configured to screen or measure how electrolyte compositions affect or modify the plating or etching process under well controlled hydrodynamic and electrical conditions.

The systems and methods utilize screening devices with microfluidic channels, mechanisms for easily attaching and detaching substrates onto the devices, controlled movement of fluids, and electrochemical control or characterizing of plating and etching processes. The screening devices are configured to allow interrogation of a multitude of bath compositions in a single test setup.

A substrate is attached to a screening device for testing bath compositions. Portions of the substrate are exposed to the action of electrolyte fluids in the microfluidic channels. After deposition on or etching of the substrate attached to the screening device, the substrate can be detached (from the screening device) and its properties characterized (e.g., film thickness, composition, microstructure, surface contamination, etc.). The characterizations of the detached substrate may be performed with different characterization instruments or tools at different locations.

By enabling the interrogation of a multitude of bath compositions in a single test setup, the screening methods and systems disclosed herein advantageously afford a reduction in the time required to screen bath compositions and minimize the amount of electrolyte used per measurement. Furthermore, the systems can be inexpensively fabricated, lowering overall processing costs.

BRIEF DESCRIPTION OF THE DRAWINGS

Further features of the disclosed subject matter, its nature, and various advantages will be more apparent from the following detailed description of the embodiments and the accompanying drawings, wherein like reference characters represent like elements throughout, and in which.

DETAILED DESCRIPTION OF THE INVENTION

Figure 1:
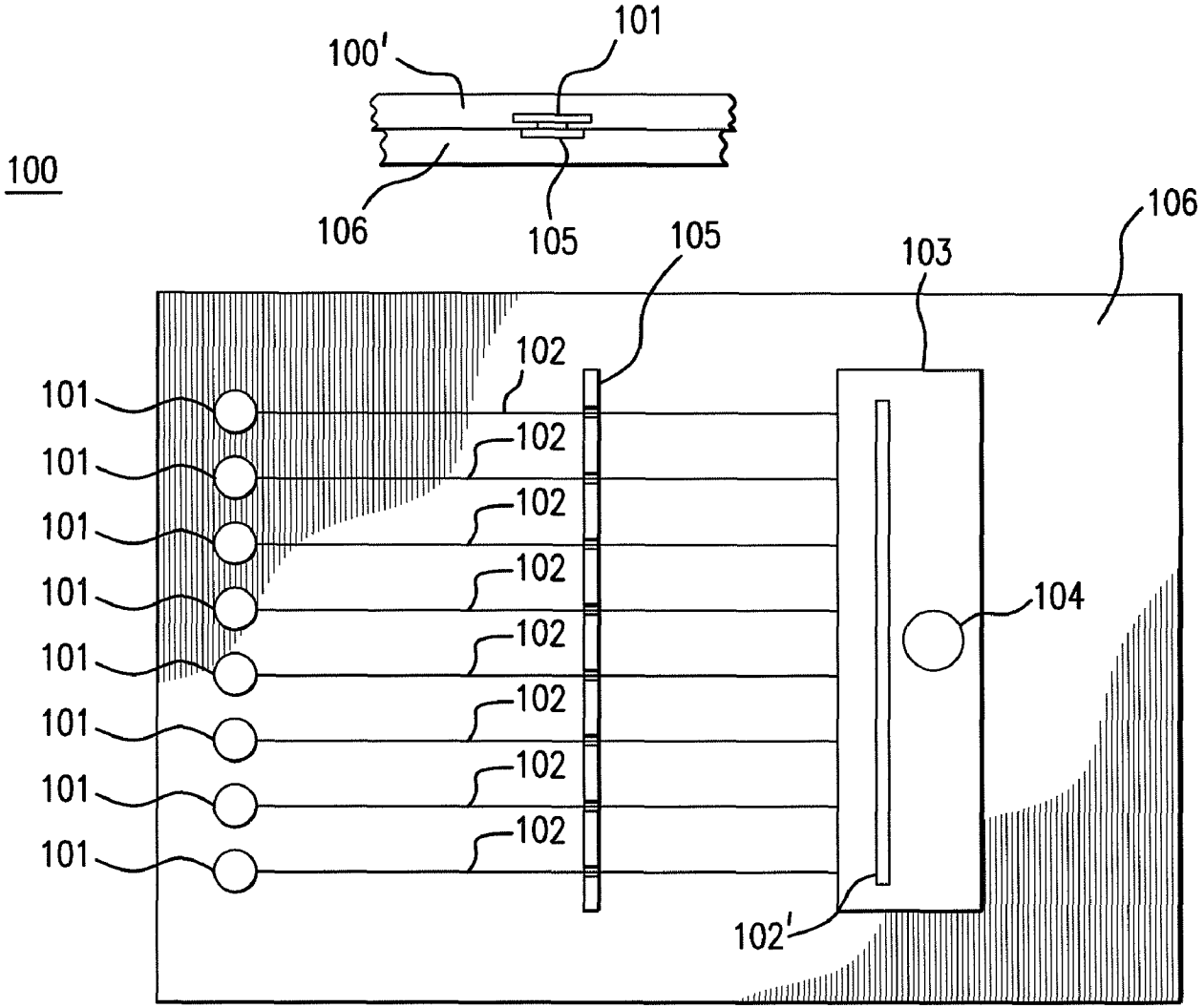
FIG. 1 is a schematic illustration of a screening device 100, in accordance with the principles of the present invention. The screening device, which may be a monolithic single part, has inlet ports 101, microchannels 102, a counterelectrode 103, and a reference electrode 104. In operation, the single part is disposed against a substrate 106 with a working electrode 105. Screening device 100 may be made of any suitable materials including, for example, polydimethylsiloxane (PDMS).

Systems and methods for screening electrolyte bath compositions are provided. The baths may be used for, for example, electroplating, electroless plating, chemical etching, electropolishing, or electrochemical etching processes. The screening systems and methods described herein enable the simultaneous screening of a plurality of bath compositions in a single test setup or experiment.

For convenience in description herein, the terms "plating," "electroplating" and "electroless plating," are used interchangeably with the equivalent terms "deposition," "electrodeposition" and "electroless deposition," respectively, as is common in the art. Processes such as electrochemical etching and electropolishing, in which a substrate is electrically controlled relative to a cathode to achieve oxidation, may also be called, for example, electro-etching, electrochemical machining or electrochemical polishing, depending on the application. The terms are used herein interchangeably, with an understanding that the need to screen electrolyte bath compositions is a desirable for all of these processes.

The screening systems and methods described herein can also be used to screen bath compositions for their impact on wafer cleaning. Wafer cleaning is an essential process step in modern semiconductor fabrication, which can be employed, for example, before or after other wafer processing steps such as chemical mechanical planarization (CMP). As CMP bath compositions are altered, for example, it is often necessary to screen for an effective composition of the bath fluids.

In addition to inorganic acids or salts, many plating or etching baths contain an extensive combination of organic additives that are present in very small concentrations. Inorganic additives such as chloride ions may also be included at a very small concentration. In plating baths, the organic additives (e.g., levelers, suppressors, inhibitors, accelerators, superfilling agents, surfactants, wetting agents, etc.) have a dramatic effect on deposit properties and also influence the plating rate. For etching baths, organic additives such as corrosion inhibitors, and inorganic ones such as chloride ions, are added to modify etching properties.

The screening systems and methods described herein can be used, for example, to screen for and tailor the amount of organic additives (e.g., accelerators) to be used in electrolyte baths. For the case of an acid-copper bath, for example, the amounts of sulfuric acid and cupric salt in the bath may be held constant and only the amount of, for example, an accelerator additive may be screened. In other cases, for example, the electropolishing of Cu in an electrolyte, various types of corrosion inhibitors in the electrolyte may be screened. The various types of corrosion inhibitors (e.g., a well-known inhibitor such as benzotriazole along with a family of molecules with a similar structure) may be screened in a single experiment or test setup. For the case of deposition of Au—Ag alloys, for example, the ratio of Au and Ag salts included in the deposition bath may be screened.

With bath composition information provided by screening using the systems and methods described herein, users can develop bath compositions which are perhaps completely novel or are simply tailored to a particular processing need at hand. As an important present day example, electroplating is used to deposit copper onto semiconductor wafers for making devices (chips) used in the computer industry. The economics of chip manufacturing requires a very high yield for each individual processing step in making the chips. Yields in a bath processing step can be greatly improved by maintaining electrolyte bath composition within a prescribed window of operation. Furthermore, as device features are reduced in size or materials change, there is a need to re-optimize additive compositions and, in some cases, to introduce new additives. The demand is thus significant for cost-effective screening methods. The disclosed subject matter enables the simultaneous screening of a multitude of bath compositions.

The systems and methods described herein achieve rapid screening using screening devices that utilize microfluidics, an interdisciplinary area of science and technology in which microfabrication methods are used to create small device structures (e.g., electrochemical cells and channels through which fluids can be pumped at low volumetric flow rates). Pumping mechanisms can be either an integral part of a microfabricated device or can exist as an "off-device" part of the system. In one low-cost embodiment, pumping may be achieved by one or more syringe pumps, each of which may drive one or more syringes feeding fluids into the microchannels.

Microfluidic technologies have been previously applied to monitoring how existing plating and etching bath compositions evolve in time due to aging. (See, e.g., West et al., International Patent Application No. PCT/US2006/012756 "SYSTEMS AND METHODS FOR MONITORING PLATING AND ETCHING BATHS," filed Jun. 4, 2006, which is incorporated by reference herein in its entirety).

In contrast to their previous applications, microfluidic technologies are used in systems and methods disclosed herein as a tool to screen or measure how electrolyte composition modifies or effects the plating or etching process, while maintaining well controlled electrical and hydrodynamic conditions in an electrochemical cell.

Well controlled electrical conditions are necessary for successful application of the electrochemical screening methods. These require reproducible electrode surfaces and suitable electronics to allow for either two- or three-electrode measurements in combination with an electrochemical cell. The suitable electronics may typically include a potentiostat, a galvanostat, and/or a power supply, possibly combined with appropriate auxiliary equipment such as multimeters, voltmeters, coulometers, etc.

Additionally, reproducible and controllable fluid flow within the electrochemical cell is required. A rotating disk electrode is a well known facile method of creating reproducible flow conditions. The disadvantage of a rotating disk electrode, however, is that only a single bath composition can be studied at a time. The systems and methods disclosed herein, utilizing microfluidic technologies, provide very reproducible and controllable fluid flows in an electrochemical cell for screening for one or more bath compositions.

FIG. 1 shows an exemplary microfluidic screening device 100 made of a single monolithic component or body 100', which forms at least an electrochemical cell when detachably held against a surface of substrate 106. Substrate 106 has a working electrode 105 disposed thereon. The working electrode is broadly defined herein as being the substrate upon which metal or alloy is being deposited or from which the metal or alloy is being etched away. Any suitable mechanism may be used to detachably hold substrate 106 and body 100' together. Suitable mechanisms that can be used to hold substrate 106 and body 100' include mechanical clamps, weights, and air pressure. When utilizing air pressure, suction may be applied via holes (not shown) that are machined through body 100' to hold substrate 106. The air pressure can also be regulated to facilitate release of substrate 106 from body 100'.

Body 100' includes microfluidic channels 102 having inlet ports 101 and optional outlet ports (not shown), counterelectrode 103, and an optional reference electrode 104. FIG. 1 shows, for example, eight inlet ports 101. It will be understood that screening device 100 is not limited to eight inlet ports, but may include any suitable number and arrangement of inlet ports 101 and microchannels 102. Preferably, each microfluidic channel 102 has at least one cross-sectional dimension which is less than 500 microns. It is noted that device 100 as shown in FIG. 1 includes an optional reference electrode 104, which is known in the art as being useful in certain types of electrochemical measurements. Reference electrode 104 may be integrated into device 100 via micro fabrication techniques, or alternatively through the use of conventional reference electrodes.

In a bath composition screening set-up, device 100 is placed against and clamped to substrate 106, which has a working electrode 105 disposed thereon. Working electrode 105 is coupled or exposed to the fluids filled in microchannels 102. Once assembled, electrolytes of possibly different compositions can flow into ports 101 leading to microfluidic channels 102 and act on portions of substrate 106 coupled to the microchannels 102.

In operation, the potential between the working and counterelectrodes is controlled using suitable electronics to achieve electrochemical reactions between the substrate and the fluids flowing through each of the eight microchannels 102. The electrochemical reactions may be etching or plating of the working electrode. The etching or plating may be different at different locations on the working electrode corresponding to different fluids in each microchannel 102. In the example shown in FIG. 1, microfluidic channels 102 merge into a single channel 102' where counterelectrode 103 is located. The merger may occur upstream or downstream of the working electrode. In the case where the microfluidic channels merge upstream of (i.e., prior to) the working electrode, excessive mixing between fluid regions of differing composition is inhibited by the small size of the channels.

Once the screening reactions have been performed, substrate 106/working electrode 105 is unclamped or detached from body 100', and the impact of bath compositions on the plating or etching reactions on substrate 106 can be analyzed ex situ by any suitable method.

For etching and deposition applications (e.g., Cu deposition) involving silicon substrates commonly used in electronic device fabrication, substrate 106 may be a silicon wafer or a fragment of a silicon wafer on which a metallic film is disposed. The metallic film may be a blanket film of one or more metallic layers. For example, the metallic film may be a relatively flat thin layer of TaN upon which a Ru layer resides. Screening may be desired to investigate how bath additives impact Cu deposition properties (for example, nucleation and growth rates) on Ru. For this example, the subsequent ex situ characterization may involve optical or electron microscopy, or profilometry analysis at different positions on the substrate to determine, for example, deposited Cu film thickness. For other processing reactions of interest, substrate 106 may be a silicon wafer which contains microfabricated features, and the efficacy of additives in filling these features without defects may be screened. In such screening, the silicon substrate may be cross-sectioned and the feature-fill quality characterized by suitable microscopy.

The screening systems and methods disclosed herein advantageously allow screening for the impact of additives such as PVP by systematically varying its concentration in small increments to obtain in one experiment or test setup a detailed characterization of the influence of PVP concentration on deposition or etch rate.

Figure 2:
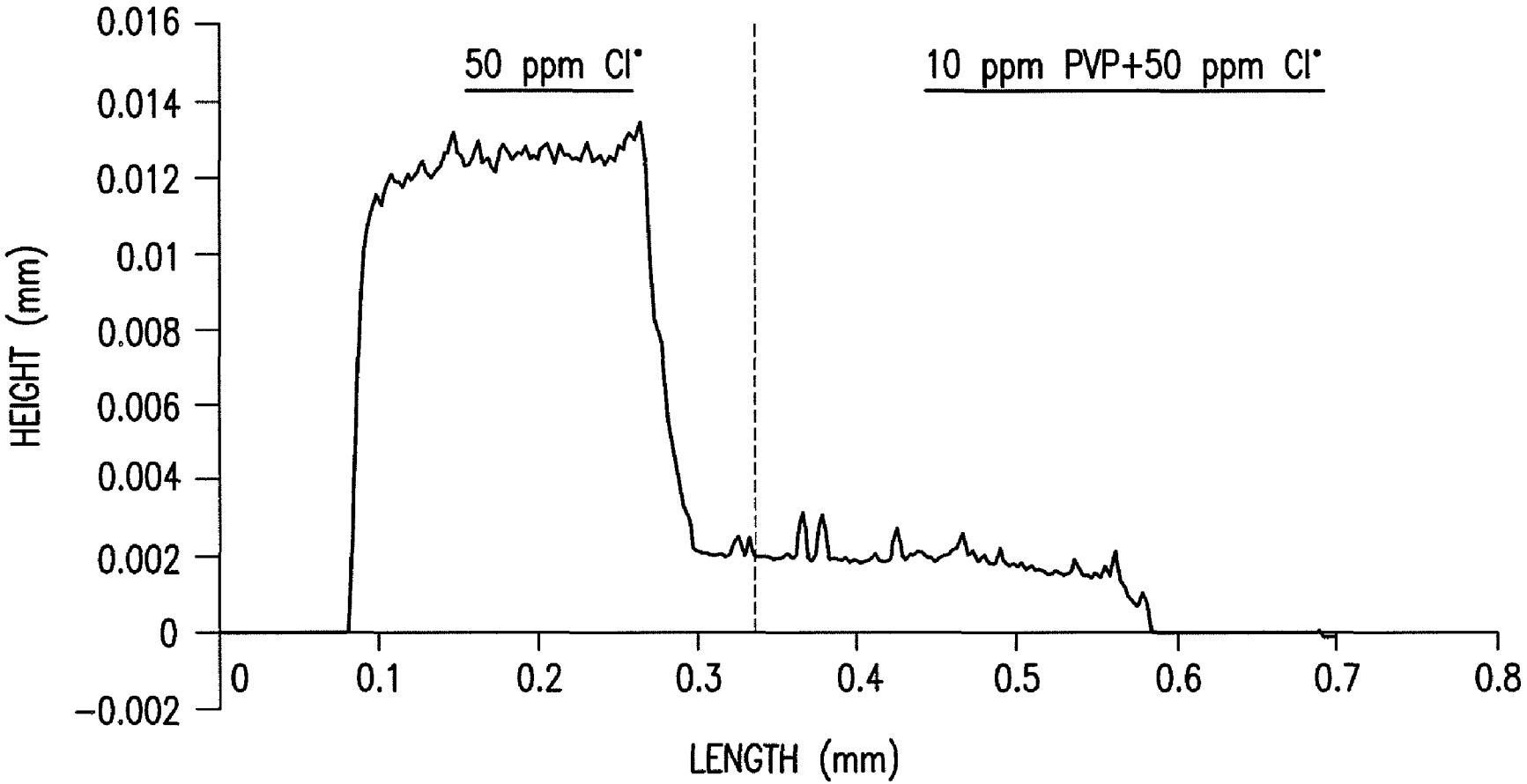
FIG. 2 is a graph of copper film thicknesses deposited on substrate 106 for two bath compositions. The film thicknesses were measured by profilometry after copper deposition for 100 seconds at an applied potential of −0.125 V relative to a silver/silver chloride (Ag/AgCl) reference electrode, in accordance with the principles of the present invention. In both baths, the cupric-sulfate concentration was 240 mM, the sulfuric acid concentration was 1.8 M, and the chloride ion concentration was 50 ppm. The second bath further contained 10 ppm of polyvinylpyrolidone (PVP), the bath component that was screened.

FIG. 2 shows exemplary profilometry measurements of Cu film thickness on substrate 106 after a screening demonstration in which copper was deposited from two bath compositions on substrate 106 for 100 seconds at an applied potential of −0.125 V relative to a silver/silver chloride (Ag/AgCl) reference electrode. In both baths, the cupric-sulfate concentration was 240 mM, the sulfuric acid concentration was 1.8 M, and the chloride ion concentration was 50 ppm. The second bath additionally contained 10 ppm of polyvinylpyrrolidone (PVP), the bath component that was screened. The thickness results shown in FIG. 2 demonstrate that PVP has a dramatic impact on deposition rates.

Figure 3:
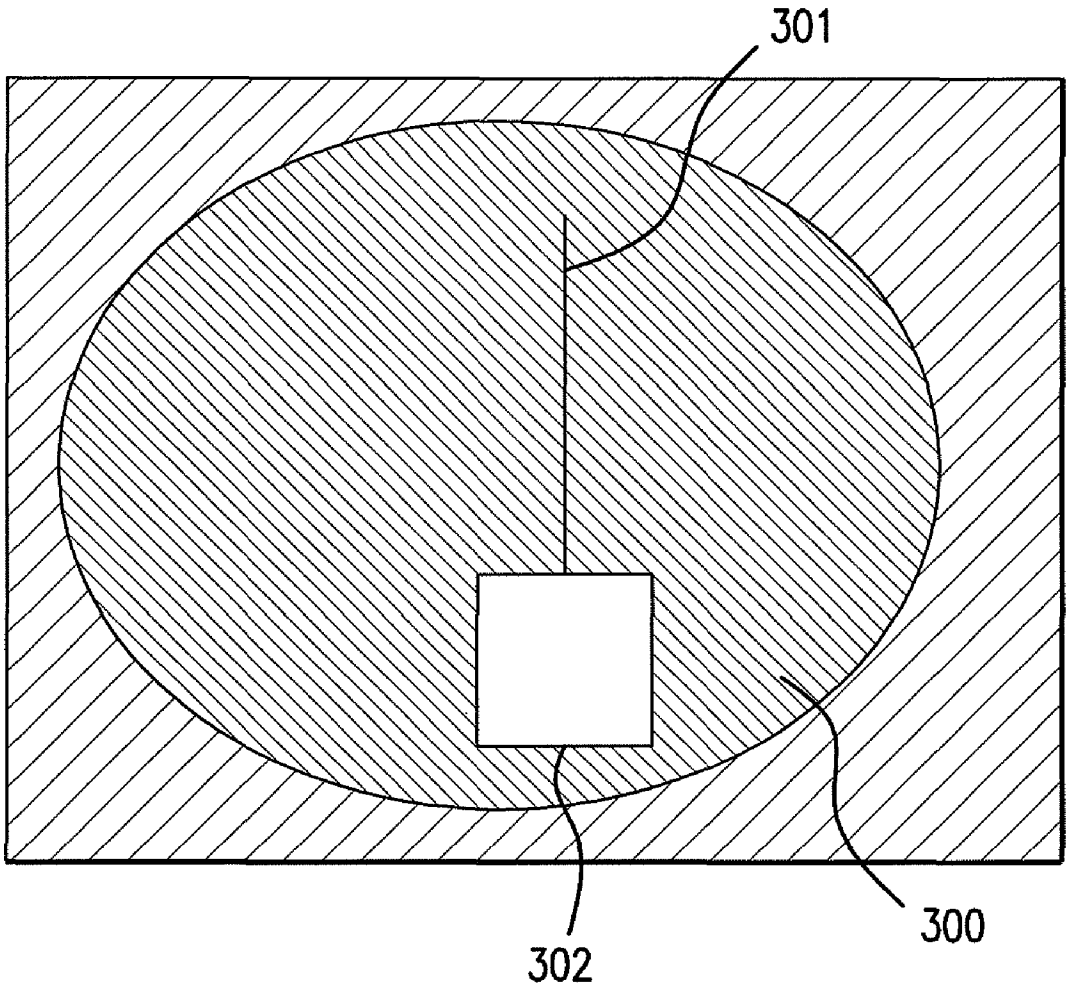
FIG. 3 is a schematic illustration of a substrate 106 that was fabricated by thermal deposition of a platinum (Pt) working electrode 301 on an oxidized silicon (Si) wafer 300, in accordance with the principles of the present invention. A titanium (Ti) film was used as an adhesion layer. Working electrode 301 is connected to a pad 302 to facilitate electrical connection to suitable electronics.

FIG. 3 shows an exemplary substrate 300 fabricated from an oxidized two-inch diameter silicon wafer. Substrate 300 was fabricated by sputter depositing Pt to the silicon wafer surface to form working electrode 301. A metallic-film (e.g., Ru, Ta, or other diffusion barrier material) was disposed underneath the Pt deposited for working electrode 301. Working electrode 310 is connected to an electrical contact pad 302 to facilitate electrical connections to system electronics. For example, a current collector (not shown) that connects the working electrode to system electronics may be fabricated by soldering a wire to contact pad 302.

Figure 4:
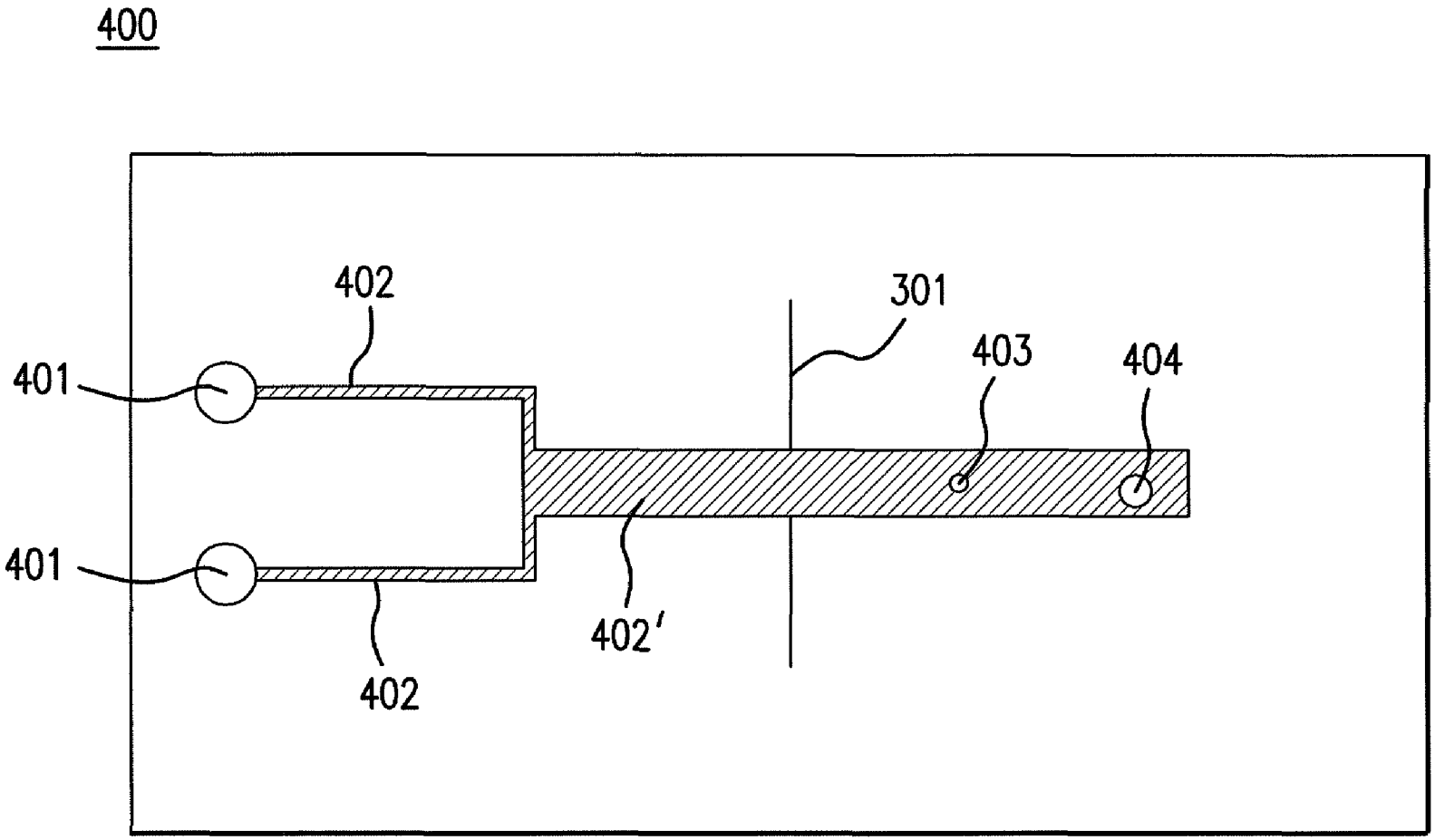
FIG. 4 is a schematic illustration of a screening device part 400 containing inlet ports 401, two microchannels 402, a counterelectrode 403, and a reference electrode 404, in accordance with the principles of the present invention.

FIG. 4 shows an exemplary screening device 400, which includes two inlet ports 401 connected to two microfluidic channels 401 that merge into one larger channel 402'. Screening device 400 also includes a counterelectrode 403 and a reference electrode 404. When attached to a substrate (e.g., substrate 300), the working electrode resides downstream of the merger point of the microfluidic channels but upstream of the counter and reference electrodes. It may be desirable to merge the microfluidic channels after the working electrode. In such cases, deposition or etching occurs only on discrete spots on the line electrode (See e.g., FIG. 1).

In exemplary screening device 400, the counterelectrode is placed downstream of the working electrode to ensure that reactions occurring on its surface do not interfere with reactions occurring on the working electrode. For some applications, it may be desirable to situate the counterelectrode on the screening device at a location directly across the microfluidic channel from the working electrode. In such case, depending on the dimensions of the working electrode, products of the counterelectrode reaction may be swept downstream before reaching across to the working electrode. This is especially likely if gas bubbles that may be produced on the counterelectrode do not grow too large.

The substrates used with the screening devices (e.g., devices 100 and 400) need not be silicon-based substrates. For example, the substrate may consist of a thin metallic foil that is imbedded in an insulating material such as an epoxy. Such a thin metallic foil/epoxy substrate may be particularly advantageous for etching studies. For example, in the development of electrolytes for use in electrochemical polishing or electrochemical-mechanical polishing of metals such as Cu, Ta, Ru that rest on top of a silicon workpiece, the metallic films may be so thin that screening of the electrolyte using realistic silicon based substrates may not be practical. In such cases, etching studies can be facilitated by using metal foils that are imbedded in an otherwise insulating substrate, which can be easily attached and detached from the screening device (e.g., device 100). The subsequent ex situ characterization methods for the etching studies may involve microscopy or profilometry analysis at different positions on the metal foil/insulating substrate just like in the case of silicon-based substrates.

With renewed reference to FIG. 3, substrate 300 can be fabricated through the application of multiple processing steps, including conventional photolithography. Photolithography may be used to limit the width of working electrode 301, for example, to dimensions less than ten times the height of the microfluidic channel on the counterpart screening device (e.g., device 400), or preferably, less than three times the height.

Figure 5B:
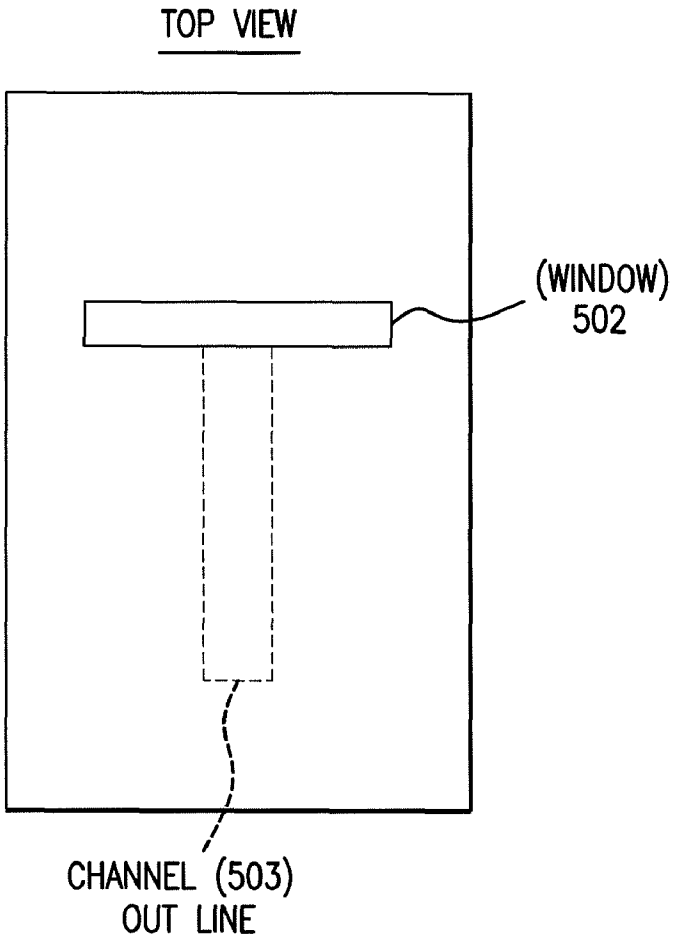
FIGS. 5A and 5B are schematic illustrations a screening device 500, in accordance with the principles of the present invention. The FIGS show a top and side view of device 500, respectively. The bottom portion (501) of the device effectively masks the substrate from the electrolyte flowing through the microfluidic channels in the device except where the substrate is disposed across window or opening 502.
Figure 5A:
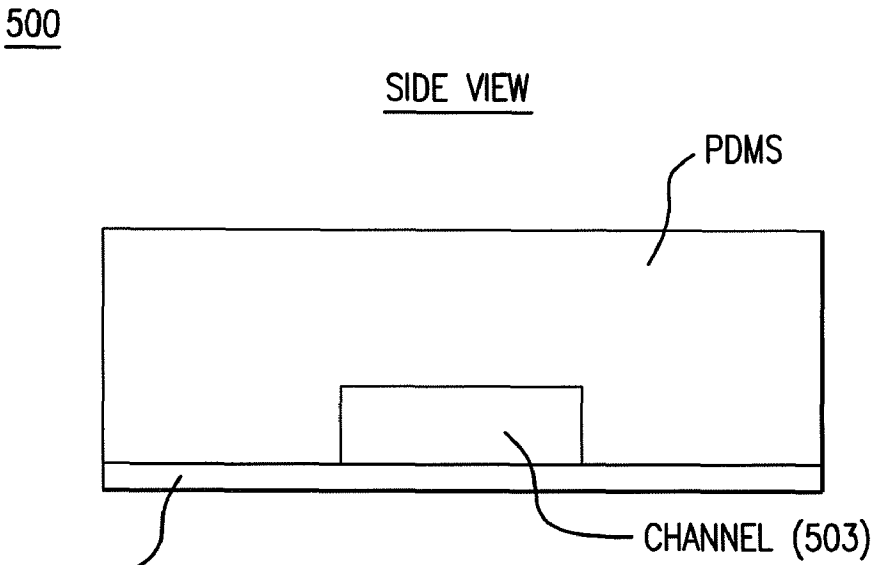

The structures of substrates suitable for use with the screening devices described herein and the fabrication steps for making such substrates may be simplified by including in the screening devices a thin masking layer that masks the fluid flowing in the micro fluid channels from the substrate except at defined openings or windows. FIGS. 5A and 5B show side and top views, respectively, of an exemplary screening device 500 in which a bottom layer 501 effectively masks the substrate from fluids flowing in a channel 503 except at window 502. It may be desirable to minimize the thickness of the masking layer 501 to avoid complications to the interpretation of screening-test results due to poor mass transfer within the electrochemical cell cavity. A common rule of thumb is that the mask-layer thickness should be less than half the width of the working electrode, preferably less than 10-20% of the working electrode width. However, screening devices with relatively thick masking layers can also be used effectively. Indeed, in certain cases, a thick mask layer may be preferred as a means of replicating through-mask plating.

Figure 6:
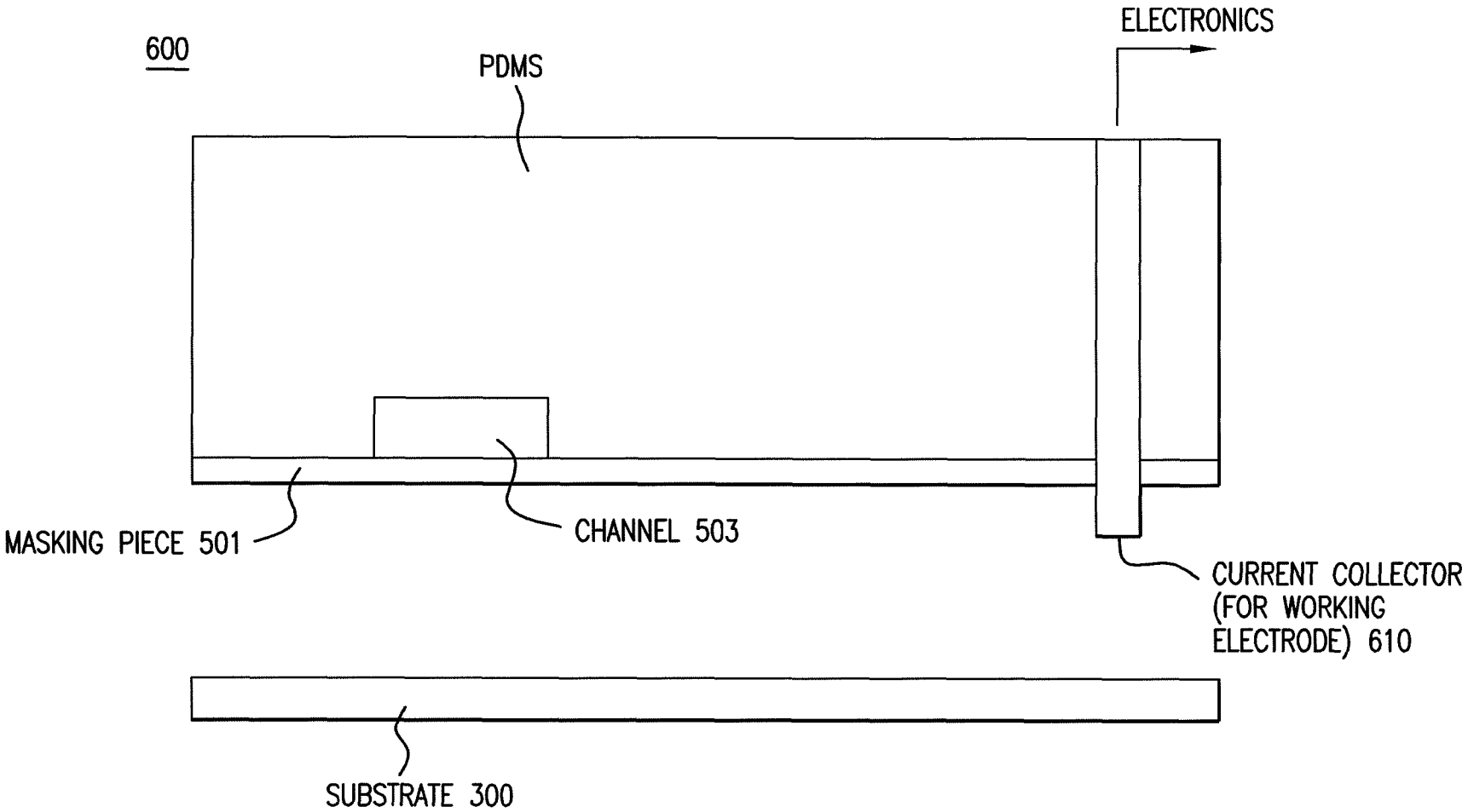
FIG. 6 is a schematic illustration of a side view of an exemplary screening device 600, which includes an integrated current collector that provides electrical contact to the substrate, in accordance with the principles of the present invention.

For some applications, the use of the screening devices (e.g., devices 100 and 400) can be further facilitated by integrating the working electrode current collector into body of the device. FIG. 6 shows, for example, a screening device 600, in which current collector 610 is a spring loaded pin having a conducting tip at one end. When screening device 600 is assembled or attached to a substrate (e.g., substrate 300) the conducting tip contacts a region (e.g., pad 302) on the substrate that is electrically connected to the working electrode (e.g., electrode 301). The other end of current collector 610 is connected to the system electronics. Devices such as device 600 with an integrated current collector may be particularly convenient for use with blanket coated substrates.

Figure 7B:
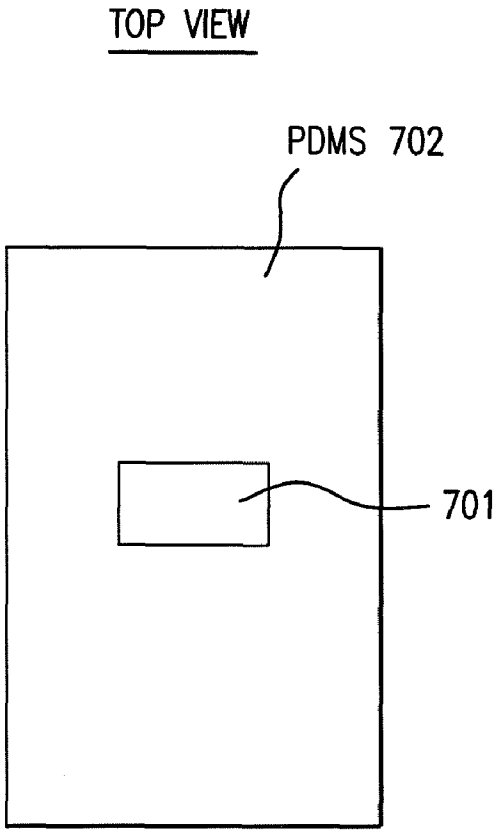
FIGS. 7A and 7B are schematic illustrations of an exemplary two-unit screening device 700 which is designed to allow easy insertion of a substrate through a side slit, in accordance with the principles of the present invention. The FIGS show a top and side view of device 700, respectively.
Figure 7A:
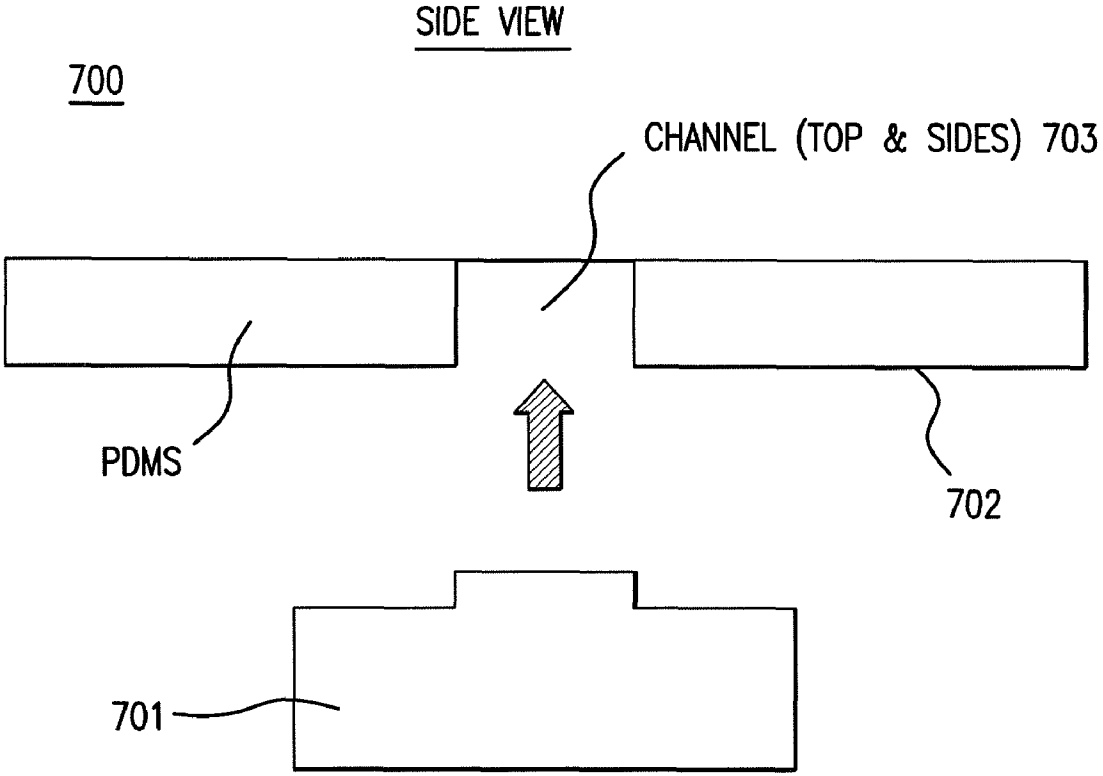

FIGS. 7A and 7B show side and top views, respectively, of yet another exemplary microfluidic bath screening device 700. Screening device 700, like devices 100, 400 and 500 includes inlet and outlet ports, microfluidic channels, a counterelectrode, and possibly a reference electrode. However, screening device 700 is fabricated as two mating units 701 and 702. The ports, channels, counterelectrode, and reference electrode may reside exclusively in one unit (e.g., 702) or maybe distributed across both units. In the present example, unit 701 has a slit into which the substrate can be easily inserted and removed through one side of the device. Since this can be achieved without separating the two mating units 701 and 702, it may be desired to permanently bond units 701 and 702 together for some applications.

It will be understood that substrates with device 700 used may be machined to ensure proper alignment of the substrate in the channels (e.g., channel 703). The electrodes (e.g., working electrodes) on which the electrolyte acts, may be flat or may have noticeable topographic features. For example, the electrodes may have high aspect ratio features that are difficult to plate by standard printed circuit board fabrication methods. In such cases, electrolyte composition may be screened by varying additive amounts. After the screening test, the so-called throwing power, determined by cross-sectioning and microscopy, may be a key metric in bath selection.

Figure 8:
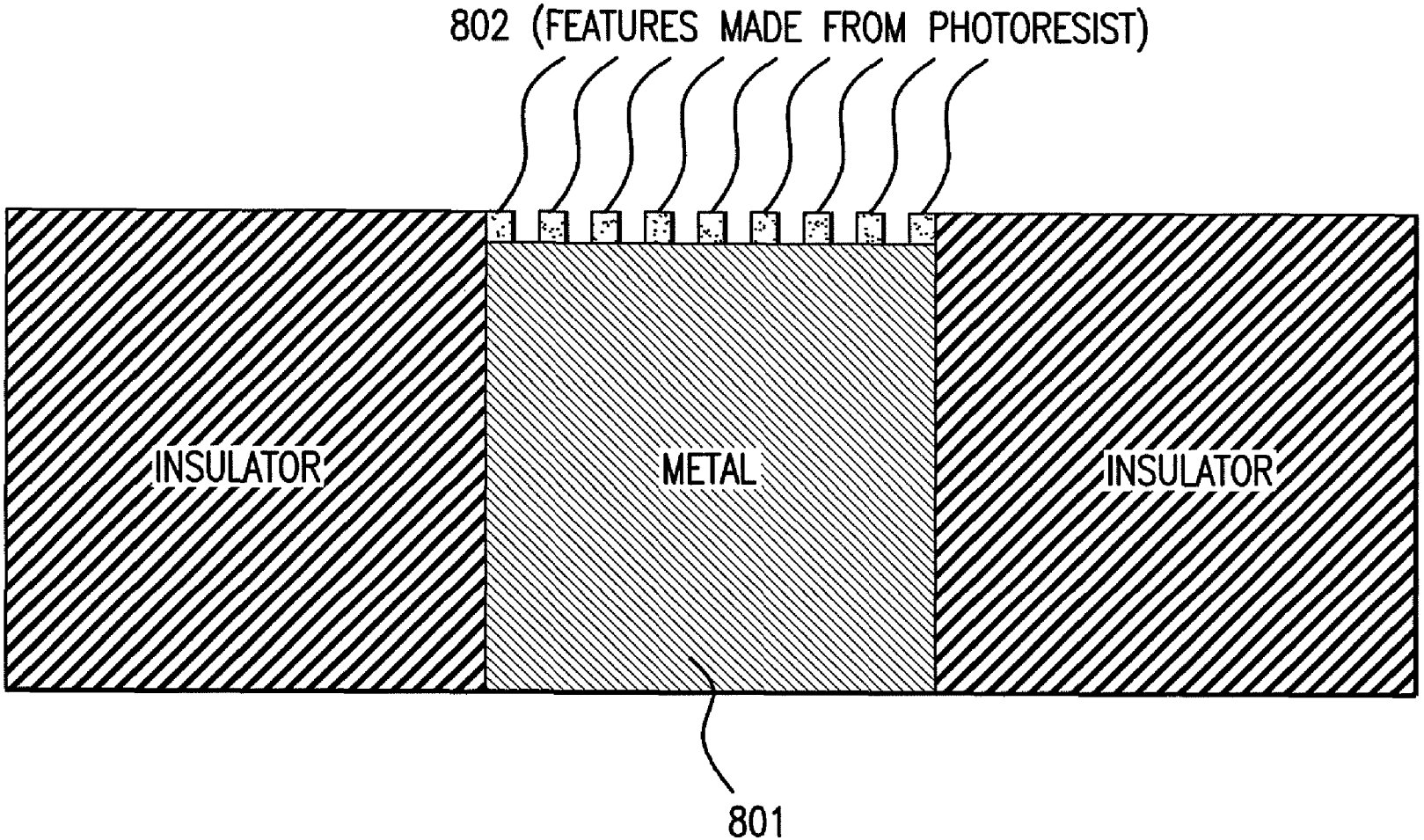
FIG. 8 is a schematic illustration of an exemplary substrate 800 including a metallic foil 801 upon which topographic features made of photoresist material 802 are formed, in accordance with the principles of the present invention.

For certain applications, the substrates may also have through-mask structures. FIG. 8 shows, for example, substrate 800 that includes photoresist features 802 made by lithography on a metal foil 801. The systems and methods described herein can be used for screening of the impact of electrolyte composition on etching anisotropy on substrates such as substrate 800. As in previous examples, after electrolyte action under controlled conditions, the substrate properties may be characterized by microscopy and by profilometry.

It is expected that the systems and methods described herein will be used advantageously for the screening of additive compositions. For alloy composition, it may be desirable that the ratio of inorganic salts (e.g., $NiCl_2$ and $FeCl_2$) for Ni—Fe deposition may be screened. Screening may be accomplished with any of the exemplary devices described above (e.g., devices 100 and 400) with consideration of the type of substrate to be employed. After a screening run, the substrate may be characterized for deposit thickness and structure, and also to determine the deposit alloy composition. In the case of electroplating of gold alloys, it is expected that the systems and methods described herein will be used advantageously for economic screening of electrolyte compositions. The systems and methods described use plating solution volumes that are small relative to conventional testing methods, which feature can translate into significant cost savings because of the cost of gold.

The screening systems and methods have been described herein with regard to the structure of the screening devices and substrates, and the flows of different electrolyte bath compositions. It will be understood that the impact of bath composition on etching or plating processes also depends on the applied potential or current density flowing between the counterelectrode and working electrode. Therefore, for proper or complete screening, the electrolyte-substrate reactions and characterization (e.g., using device 100) may have to be repeated in test setups for different currents flowing between the counterelectrode and working electrode.

Figure 9:
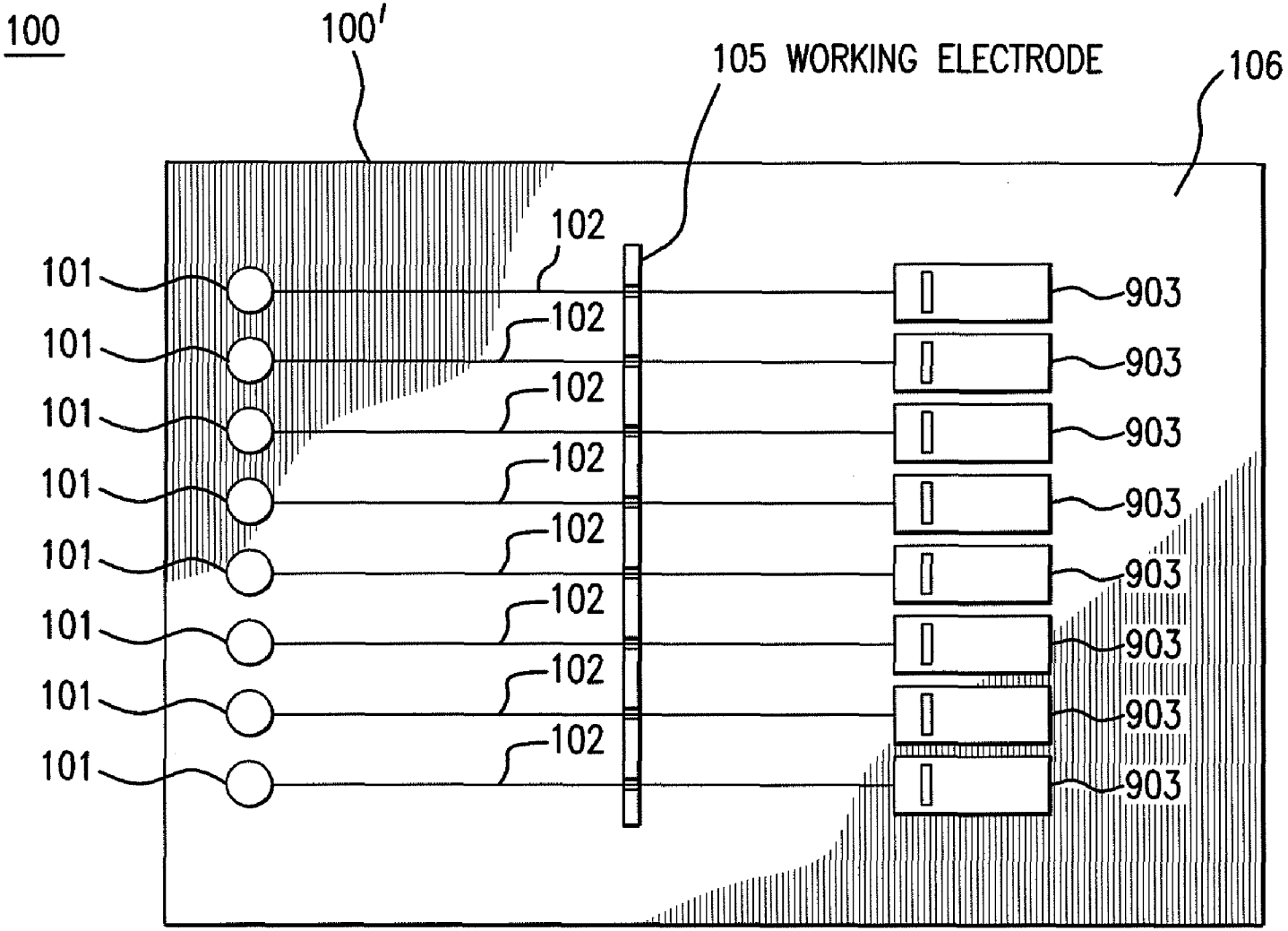
FIG. 9 is a schematic illustration of an exemplary screening device 900 having multiple counterelectrodes 903, in accordance with the principles of the present invention. The multiple counterelectrodes 903 allow for individual control of current flowing through each of the microfluidic channels in the device, allowing for screening of the impact of applied current density in addition to bath composition.

FIG. 9 shows an exemplary device 900, which can be used to screen electrolytes for different applied currents in a single test setup. Device 900, like device 100, has eight inlet ports 101 and eight microchannels 102. However, in device 900, counterelectrode 103 of device 100, is replaced by eight discrete electrodes 903, each of which can be individually addressed by suitable electronics as is well known in the art. The current flowing to each counterelectrode can be systematically varied. The electrolyte composition within each microfluidic channel may also be varied, allowing for screening of both composition and applied current or potential in a single test.

It will be understood that various microchannel and electrode configurations can be deployed in a screening device to allow screening of various combinations of electrolyte compositions and electrical potential/current conditions in a single test setup. For example, four bath compositions may be tested at four current densities with a single screening device. The flow of each bath composition fluid may be split into four separate streams via an external or on-chip manifold.

It is noted that the screening systems and methods have been described herein as involving a counterelectrode and suitable electronics since electroplating and electrochemical etching processes require an anode and a cathode. It will be, however, understood, the screening systems and methods disclosed herein may not require the counterelectrode when screening for electroless plating, chemical etching, or wafer cleaning bath composition. The devices disclosed above can be therefore fabricated without them, although for some studies, the counterelectrode and possibly the reference electrode may be desired.

The foregoing merely illustrates the principles of the invention. Various modifications and alterations to the described embodiments will be apparent to those skilled in the art in view of the teachings herein. It will be appreciated that those skilled in the art will be able to devise numerous modifications which, although not explicitly described herein, embody the principles of the invention and are thus within the spirit and scope of the invention.

What is claimed is:

1. A system for simultaneously screening impacts of a plurality of electrolyte bath compositions on a first electrode structure disposed on a substrate, the system comprising:

a device having multiple microfluidic channels, each microfluidic channel having an inlet port for receiving a fluid corresponding to one of the plurality of bath compositions, wherein in operation, the device is detachably disposed on the substrate so that different fluids corresponding to the plurality of bath compositions received in the multiple microfluidic channels act on different portions of the first electrode structure, thereby enabling simultaneous screening of the impacts of the plurality of bath compositions on the first electrode structure disposed on the substrate;

wherein the impact is selected from the group consisting of etching and plating.

2. The system of claim 1, wherein the first electrode structure is coupled to the multiple microfluidic channels at diverse portions thereof so that different fluids corresponding to the plurality of bath compositions received in the multiple microfluidic channels act on diverse portions of the first electrode structure.

3. The system of claim 2, wherein the multiple microfluidic channels lead to at least one merged microfluidic channel, further comprising a second electrode structure coupled to the at least one merged microfluidic channel.

4. The system of claim 1, further comprising a second electrode structure coupled to the multiple microfluidic channels such that the first electrode structure is interposed between the inlet ports and the second electrode structure.

5. The system of claim 4, wherein the second electrode structure a comprises multiplicity of second electrodes, each corresponding to one of the multiple microfluidic channels and coupled thereto.

6. The system of claim 1, wherein the multiple microfluidic channels lead to at least one merged microfluidic channel, and wherein the first electrode structure is coupled to the at least one merged microfluidic channel.

7. The system of claim 6, further comprising a second electrode structure coupled to the at least one merged microfluidic channel such that the first electrode structure is interposed between the inlet ports and the second electrode structure.

8. The system of claim 6, wherein the device having multiple microfluidic channels further comprises a masking layer having an opening therein for coupling at least one of the microfluidic channels to the first electrode structure.

9. The system of claim 1, wherein the device further comprises a current collector having an electrically conducting tip for contacting said first electrode structure disposed on the substrate.

10. A method for simultaneously screening impacts of a plurality of electrolyte bath compositions on a first electrode structure disposed on a substrate, the method comprising:

exposing different portions of the first electrode structure disposed on the substrate to the action of different fluids corresponding to a plurality of electrolyte bath compositions, comprising detachably disposing a device having multiple microfluidic channels on the substrate, each microfluidic channel having an inlet port for receiving a fluid corresponding to one of the plurality of bath compositions, so that different fluids corresponding to the plurality of bath compositions received in the multiple microfluidic channels act on the different portions of the first electrode structure, thereby enabling simultaneous screening of the impacts of the plurality of bath compositions on the first electrode structure disposed on the substrate;

wherein the impact is selected from the group consisting of etching and plating.

11. The method of claim 10, further comprising characterizing the different portions of the first electrode structure acted upon by the different fluids corresponding to plurality of electrolyte bath compositions.

12. The method of claim 10, wherein detachably disposing a device having multiple microfluidic channels on the substrate comprises coupling the first electrode structure to the multiple microfluidic channels at diverse portions thereof so that different fluids corresponding to the plurality of bath compositions received in the multiple microfluidic channels act on diverse portions of the first electrode structure.

13. The method of claim 10, wherein detachably disposing a device having multiple microfluidic channels on the substrate comprises:

disposing a device in which the multiple microfluidic channels lead to at least one merged microfluidic channel; and coupling the first electrode structure to the at least one merged microfluidic channel.

14. The method of claim 10, wherein detachably disposing a device having multiple microfluidic channels on the substrate comprises disposing a device having a second electrode structure and coupling the second electrode structure to the multiple microfluidic channels.

15. The method of claim 14, wherein detachably disposing a device having multiple microfluidic channels on the substrate comprises:

disposing a device in which the multiple microfluidic channels lead to at least one merged microfluidic channel; and coupling the second electrode structure to the at least one merged microfluidic channel.

16. The method of claim 10, wherein detachably disposing a device having multiple microfluidic channels on the substrate comprises: disposing a device having a masking layer with an opening therein for coupling at least one of the microfluidic channels to the first electrode structure.

17. The method of claim 10, wherein detachably disposing a device having multiple microfluidic channels on the substrate comprises:

disposing a device having a current collector with an electrically conducting tip; and contacting the first electrode structure disposed on the substrate with the electrically conducting tip.

* * * * *